US006041942A

United States Patent [19]

Goolsby

[11] Patent Number: 6,041,942

[45] Date of Patent: Mar. 28, 2000

[54] MAGNETIC CATALYST SEPARATION USING STACKED MAGNETS

[75] Inventor: Terry L. Goolsby, Katy, Tex.

[73] Assignee: Kellogg Brown & Root, Inc., Houston, Tex.

[21] Appl. No.: 09/022,425

[22] Filed: Feb. 12, 1998

Related U.S. Application Data

[60] Provisional application No. 60/038,818, Feb. 12, 1997, provisional application No. 60/037,686, Feb. 12, 1997, provisional application No. 60/037,687, Feb. 12, 1997, and provisional application No. 60/037,688, Feb. 12, 1997.

[51] Int. Cl.[7] ..... B03C 1/00

[52] U.S. Cl. ..... 209/219; 209/222; 209/214

[58] Field of Search ..... 209/217, 218, 209/222, 219, 225, 226, 227, 228, 230

[56] References Cited

U.S. PATENT DOCUMENTS

| | | |
|---|---|---|
| Re. 31,439 | 11/1983 | Rosensweig . |
| Re. 35,046 | 10/1995 | Hettinger, Jr. et al. . |
| 3,711,422 | 1/1973 | Johnson et al. . |
| 4,359,379 | 11/1982 | Ushio et al. . |
| 4,406,773 | 9/1983 | Hettinger, Jr. et al. . |
| 4,482,450 | 11/1984 | Ushio et al. . |
| 4,727,623 | 3/1988 | Thompson et al. . |
| 4,823,102 | 4/1989 | Cherian et al. . |
| 4,882,043 | 11/1989 | Jung . |
| 5,147,527 | 9/1992 | Hettinger . |
| 5,171,424 | 12/1992 | Hettinger . |
| 5,190,635 | 3/1993 | Hettinger . |
| 5,198,098 | 3/1993 | Hettinger, Jr. . |
| 5,230,869 | 7/1993 | Hettinger et al. . |
| 5,250,482 | 10/1993 | Doctor . |
| 5,328,594 | 7/1994 | Hettinger . |
| 5,364,827 | 11/1994 | Hettinger et al. . |
| 5,393,412 | 2/1995 | Hettinger . |
| 5,448,803 | 9/1995 | Morell . |
| 5,538,624 | 7/1996 | Hettinger . |

OTHER PUBLICATIONS

Magnet Terminology Glossary, Magnet Sales and Manufacturing, Inc.

*Primary Examiner*—Donald P. Walsh
*Assistant Examiner*—Brett C. Martin
*Attorney, Agent, or Firm*—Kellogg Brown & Root, Inc.

[57] ABSTRACT

An improved magnet configuration of the magnet field generated by the magnetic roller in a magnetic separator to increase the separation capability of magnetic separators includes disc shaped magnets forming a magnetic roller beneath a Kevlar™ belt upon which withdrawn catalyst is placed. Catalyst particles having paramagnetic and/or ferromagnetic properties are attracted to the belt because of the influence of the magnetic field. Particles not having ferromagnetic and/or paramagnetic properties are carried further by momentum than those with the ferromagnetic and/or paramagnetic properties. The magnetic roller provides a concentrated magnetic field by placing a series of disc magnets arranged so that like poles face each other with spacers placed between the magnets. In this stacked configuration the magnetic field strength is doubled, which permits a greater range of operation of the speed at which the belt may be operated.

14 Claims, 2 Drawing Sheets

MAGNETIC CATALYST SEPARATION USING STACKED MAGNETS

CROSS-REFERENCE TO RELATED APPLICATION

This application claims the benefit under 35 USC §119(e) of provisional U.S. Ser. Nos. 60/037,686, 60/037,687, 60/037,688, and 60/037,818, all filed Feb. 12, 1997, and all of which are incorporated by reference herein.

FIELD OF THE INVENTION

The present invention pertains to catalyst separation techniques in oil refining processes, more particularly to magnetic catalyst separation where older, contaminated catalyst inventory is separated through magnetism and discarded, while newer catalyst stock is returned to the circulating catalyst inventory, and especially to the configuration of the magnets for better magnetic separation.

BACKGROUND OF THE INVENTION

Magnetic separation has been historically active in several different industries and has only recently been utilized in petroleum refining. Development of economical permanent magnets with high magnetic strength has led to a new process that separates less active (high metals) catalyst particles from equilibrium FCC catalyst, producing a higher activity/lower metals catalyst for recycle.

As the cost of operating a refinery increases due to environmental constraints, as well as increases in raw material and maintenance costs, refiners look for processes which improve refining margins with the least amount of capital investment. Fluidized catalytic cracking (FCC) in particular has a significant bottom line effect on both refining revenue generation and cost. FCC costs include virgin catalyst purchase as well as spent catalyst disposal, which can be significant at times. Both of these can be offset to a degree by utilization of a new process that removes the older, higher metals laden, less active catalyst from the circulating inventory by dry magnetic separation techniques, to produce a lower metals/higher activity and higher selectivity catalyst.

Magnetic separation techniques have been around for years in the mining, food and other industries. These techniques include the utilization of eddy currents, electromagnets and permanent magnets for separation of magnetic from non-magnetic material on a wet or dry basis. Electromagnets use electricity to induce a magnetic field in a metallic object by flowing electrons through a wire-wound core to induce a magnetic field in a metal object in the center of the core. These types of magnets are relatively expensive and operating costs are usually high due to the consumption of electricity. Permanent magnets are generally used in operations where the material being removed exhibits strong ferromagnetic and/or paramagnetic properties.

Magnetic separation of metals-contaminated equlibrium catalyst (ECat) from ECat particles having a lower metal content has recently been commercialized. Aspects of this process are disclosed in one or more of U.S. Pat. No. 4,406,773 to Hettinger, Jr. et al.; U.S. Pat. Re. 35,046 to Hettinger, Jr. et al.; U.S. Pat. No. 5,147,527 to Hettinger, Jr. et al.; U.S. Pat. No. 5,171,424 to Hettinger; U.S. Pat. No. 5,190,635 to Hettinger; U.S. Pat. No. 5,198,098 to Hettinger, Jr.; U.S. Pat. No. 5,230,869 to Hettinger et al.; U.S. Pat. No. 5,328,594 to Hettinger; U.S. Pat. No. 5,364,827 to Hettinger et al.; U.S. Pat. No. 5,393,412 to Hettinger; U.S. Pat. No. 5,538,624 to Hettinger; all of which are hereby incorporated by reference. Some other work has been done in the area of magnets separation of FCC catalyst. U.S. Pat. No. 5,250,482, to Doctor, which is hereby incorporated by reference, used a super-cooled, quadrupole open-gradient magnetic separation system to separate ECat having more than about 2000 ppm nickel equivalents from ECat having less about 2000 ppm nickel equivalents.

SUMMARY OF THE INVENTION

The present invention provides an improved magnet configuration to increase separation capability of magnetic separators. In a magnetic separator having a magnetic roller and a non-magnetic roller, a magnetic roller having a plurality of disc-shaped magnets is provided beneath a belt upon which withdrawn catalyst is placed. Catalyst particles having paramagnetic and/or ferromagnetic properties adhere to the belt in the vicinity of the magnetic roller because of the magnetic field. Particles not having ferromagnetic and/or paramagnetic properties are carried further by momentum than those with the ferromagnetic and/or paramagnetic properties. The method and apparatus of the present invention provide a concentrated magnetic field by placing a series of disc magnets arranged so that like poles face each other. In this stacked configuration the magnetic field strength is effectively doubled, which permits a greater range of operation of the speed at which the belt may be operated.

Accordingly, the present invention provides an apparatus for magnetically separating cracking catalysts. The apparatus includes: a flexible, continuous belt movable around first and second rollers at opposite ends thereof for receiving a catalyst stream on an upper surface thereof. One of the rollers comprises a plurality of stacked magnetic discs with like poles facing each other to provide a concentrated magnetic field to influence particles in the catalyst stream having magnetic properties. The apparatus preferably includes spacers between adjacent magnetic discs. Preferably, the belt is made of a woven aromatic polyamide fiber. The belt can be from 5 to 60 mils thick, preferably 5 to 10 mils. The first roller can be non-magnetic. The magnetic discs can be made from permanently magnetic rare earth metal.

The present invention also provides a method for magnetically separating cracking catalysts. The method includes moving a flexible continuous belt around first and second rollers at opposite ends thereof. One of the rollers comprises a plurality of stacked magnetic discs with like poles facing each other to provide a concentrated magnetic field. The method further includes depositing a catalyst stream on an upper surface of the belt and using the magnetic field to influence particles in the catalyst stream and to separate the stream into at least two fractions comprising a first fraction which has a higher metals content than a second fraction which has a relatively low metals fraction. Spacers are preferably disposed between adjacent magnetic discs. The belt preferably comprises a woven aromatic polyamide fiber, preferably from 5 to 60 mils thick, more preferably from 5 to 10 mils thick. The first roller can be non-magnetic. The magnetic discs are preferably made of permanently magnetic rare earth metal.

DETAILED DESCRIPTION OF THE INVENTION

In present day fluidized catalytic cracking (FCC) units a significant problem occurs in the recharging of the cracking catalyst. Over a period of time, the catalyst becomes contaminated with impurities that are present in the crude oil feedstock. These impurities can take many forms, one of which is a ferromagnetic impurity (nickel and iron) and another is a paramagnetic impurity (vanadium). Both of these can be used in selectively removing contaminated catalyst from the catalyst stream. As time proceeds, more and more of the magnetic impurities adhere to the catalyst, making the catalyst more and more susceptible to the influence of magnetic fields. In essence, the longer a catalyst has been in use, the greater the amount of impurities present in that particular particle of catalyst and the greater its susceptibility to magnetic forces. In this case, by controlling the speed at which the magnetic separator belt is operated and/or the strength of the magnetic field, the age of the oldest particle of catalyst can theoretically be controlled. This means that, in general, older and presumably more contaminated catalyst particles, can be magnetically separated from the catalyst stream and discarded.

Unfortunately, not all impurities are either paramagnetic or ferromagnetic. As a result, catalyst particles can become clogged with impurities and exhibit no magnetic tendencies. In this situation, rare earth paramagnetic/feromagnetic materials that act as "hooks" can be added each time the catalyst stream is withdrawn to gradually add more and more paramagnetic properties to the catalyst particles as they age. The longer a catalyst particle is in the fluidized catalytic cracking unit, the more times it will have been withdrawn and the more "hooks" it will have attached, making it more and more magnetic. Thus, it can be removed by a magnetic separator.

Figure 1:
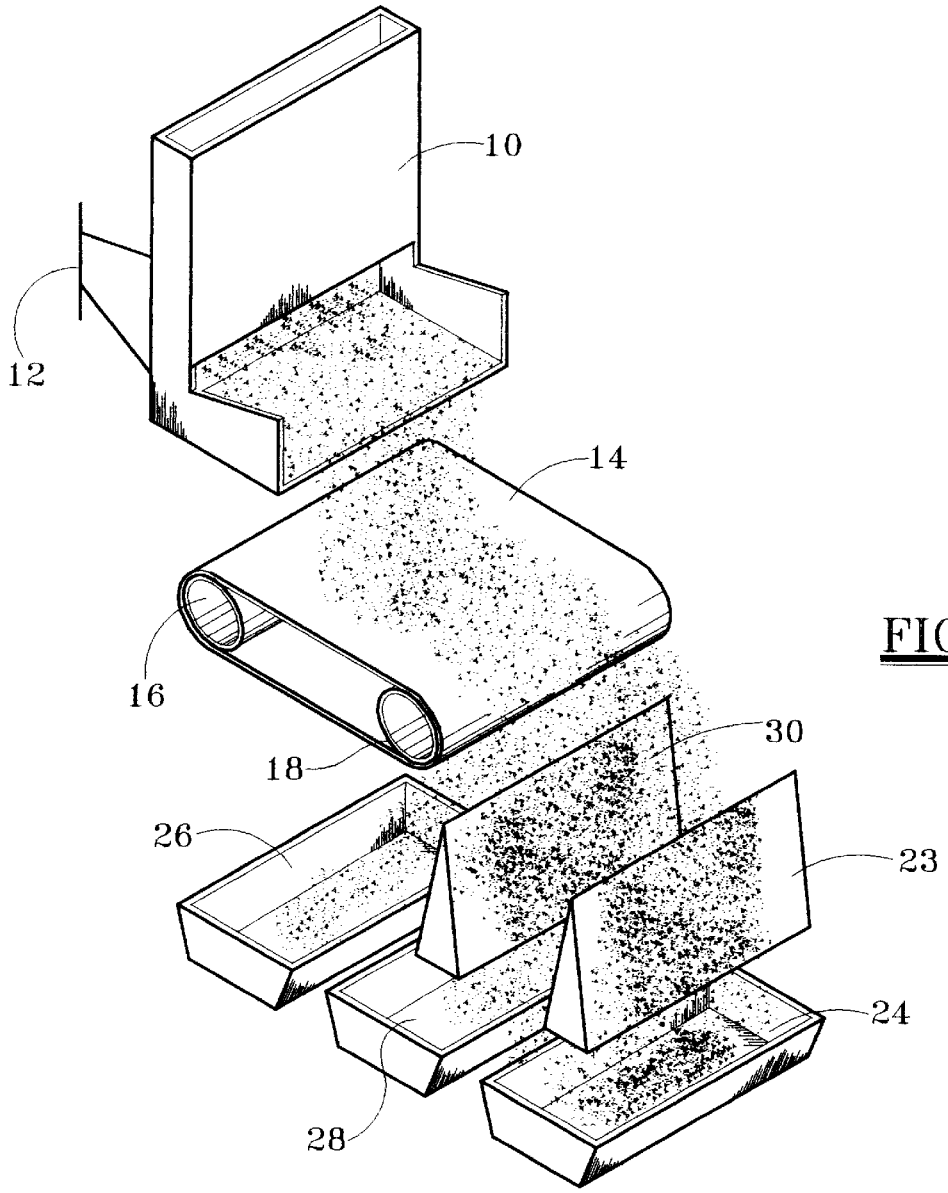
FIG. 1 is a perspective schematic view of a magnetic separator unit having magnetic and non-magnetic rollers.

Referring now to FIG. 1, an abbreviated magnetic separator system is schematically illustrated. In practice, there is a feeder 10 which is vibrated by vibrator 12 to deposit catalyst particles on flexible continuous belt 14. Belt 14 may be of any type in use in the art although a belt made of woven aromatic polyamide fiber, such as KEVLAR™, is preferred due to its durability and strength. In one preferred embodiment, a belt 14 approximately 10 mils thick is used, however, a belt 5 mils thick may also be used as indicated in the examples and data that follow below.

Belt 14 is stretched over follower roller 16 and leader roller 18. In one preferred embodiment, follower roller 16 is non-magnetic and functions primarily to provide a complete path for belt 14 to travel. Leader roller 18 is magnetic and is comprised of a plurality of disc shaped magnets 20A–20T arranged in a bucking configuration and separated by spacers 22A–22U (see FIGS. 2–4). The function of leader roller 18 is to establish a magnetic field by which catalyst particles having paramagnetic or ferromagnetic properties may be influenced.

In practice, a stream of catalytic particles are placed on belt 14. As belt 14 rotates, the catalyst particles are carried forward at a belt 14 speed of preferably up to 340 feet per minute (fpm) and establish momentum. Paramagnetic impurities and ferromagnetic impurities that adhere to the catalyst particles are attracted to the magnets 20A–20T or are influenced by the magnetic field provided by the magnets 20A–20T. Newly added catalyst particles without a great amount of impurities are not influenced as greatly by the magnetic field and when the particles reach the end of belt 14, they continue with substantial momentum past the end of the roller 18 where belt 14 turns around and returns to the follower roller 16 where more catalyst particles are placed on belt 14. However, catalyst particles having a large amount of contamination, either through feedstock impurities or added rare earth paramagnetic "hooks", are drawn back to leader roller 18 due to magnetic attraction. Particles with little or no magnetic properties are thus propelled by inertial forces past splitter 23 to a collection chute 24 which is horizontally spaced from the roller 18. Particles with highly magnetic properties are held by the roller 18 to be collected in chute 26. If desired, another chute 28 and splitter 30 can be used to separate the catalyst particles into relatively more and less magnetic cuts. The more magnetic particles are thus collected in chute 26, while the less magnetic particles are collected in chute 28 and the non-magnetic particles are collected in chute 24.

Figure 2:
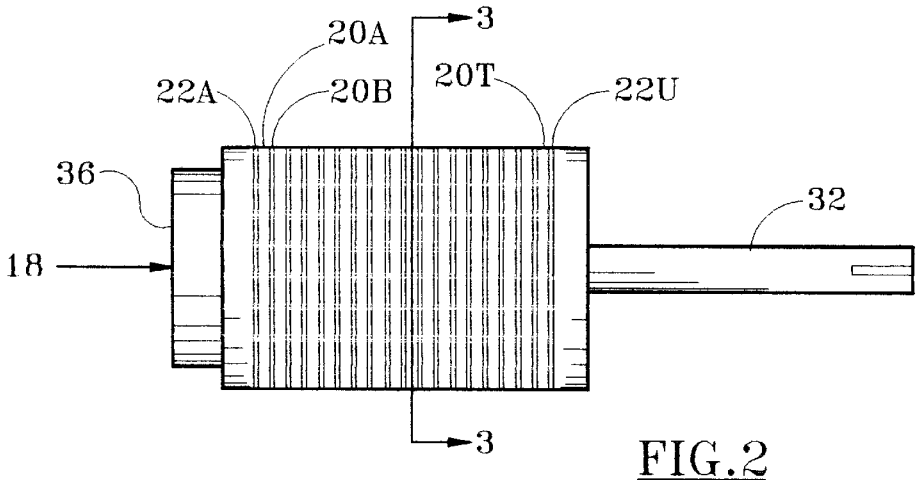
FIG. 2 is a plan view of the magnetic roller of FIG. 1 illustrating the bucking configuration of the permanent magnets.
Figure 3:
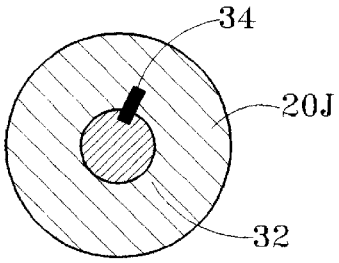
FIG. 3 is a cross-sectional view of the magnetic roller of FIG. 2 as seen along the lines 3—3.
Figure 4:
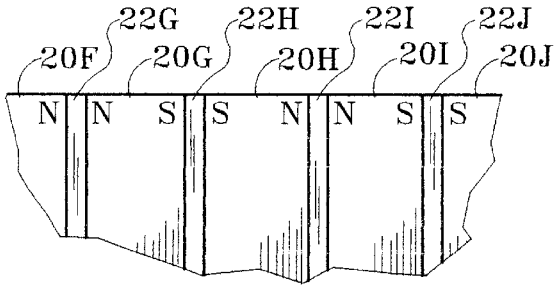
FIG. 4 is an enlarged view of the magnetic roller of FIGS. 2–3 showing the relative polarity of adjacent magnets.

Referring now to FIGS. 2–4, plan and cross-sectional views of leader roller 18 illustrate a plurality of disc shaped magnets 20A–20T, with disc shaped spacers 22A–22U on either side of each magnet 20A–20T, all mounted on shaft 32. The overall width of magnets 20A–20T and spacers 22A–22U is at least as great as the width of the belt 14. Shaft 32 may be driven by any means currently in use in the art, electrically, either DC or AC, hydraulics, etc., as long as it has the capability of being adjustably driven up to 350 revolutions per minute (rpm).

Magnets 20A–20T are radial magnets configured so that north poles face each other on adjacent magnets and south poles also face each other on adjacent magnets. See FIG. 4. Longitudinal spline 34 and end members 35 secured on the shaft 32 hold the magnets 20A–20T in relative position. See FIG. 3. On either end and between each magnet 20A–20T is a spacer 22A–22U. Thus, the series of discs is spacer 22A, magnet 20A, spacer 22B, magnet 20B, spacer 22C, and so on to magnet 20T, and spacer 22U. Each of the magnets 20A–20T preferably measures from 3 to 4 inches in diameter and from 0.2 to 0.5 inches thick, more preferably from 0.3 to 0.45 inches thick. The spacers 22A–22U have about the same diameter as the magnets 20A–20T and a thickness from about 0.125 to about 0.25 inches. If the spacers 22A–22U are too thin they will tend to demagnetize the magnets 20A–20T, whereas if the spacers 22A–22U are too thick the number of magnetic poles will be reduced. The composition of the magnets 20A–20T is not particularly critical to the invention and any rare earth magnetic material can be used, for example, neodymium—iron—boron magnets are suitably employed.

From 10 to 200 magnets can be used to provide an overall width of from 10 cm to 2 m, more preferably from about 60 to about 180 magnets and an overall width of from 1 to 2 m. The magnets preferably measure from about 75 mm to about 100 mm (about 3 to 4 inches) in diameter, providing a magnetic field strength from 5,000 to 25,000 gauss; however, any number of magnets in any suitable dimension and composition may be used as long as they are configured such that like poles face each other to increase the magnetic field strength.

Magnets 20A–20T may also be of any type of permanent magnets currently in use in the art. In the preferred embodiment, a total of twenty-one spacers are used, one to separate each magnet and one on either end. Spacers 22A–22U may be either magnetic or non-magnetic material. A non-magnetic material such as stainless steel is easier to work with since the natural repulsion of the north and south poles facing each other can be significant depending on the strength of the magnets. However, using magnetic materials can be used to focus or direct the combined magnetic force of the two magnets side by side.

We believe that the key element in using magnetic fields to passivate the catalyst with respect to coke and hydrogen formation is repeated contact of catalyst particles with a strong magnetic field. The strong magnetic field obtained by using the magnets in a bucking configuration according to this invention accelerates the passivation process. Increasing passivation is preferably coupled with a gradual increase in belt speed as the catalyst is magnetized, thus allowing the circulating catalyst to have higher metals levels than were used with virgin catalyst.

In practice, magnetic passivation does not happen overnight, or even within a month. Perhaps something happens after one month, with the full effect not usually seen until two months, six months or even a year elapses. A curious feature of this invention is that the more the catalyst passes through the magnetic separation process, the better the catalyst recycled to the FCC unit becomes at following a corollary to Markovnikov's rule. The catalyst with the most metals attracts the most metals from the petroleum feedstock. Metals in the incoming feed preferentially deposit on relatively large deposits, possibly large crystals of magnetized metal already present on the cracking catalyst.

The large crystal sizes associated with the magnetically treated catalyst, or perhaps the residual magnetism of the magnetized catalyst, makes the metals-rich, magnetized catalyst more attracted to magnetic fields than conventional catalyst. Thus, we prefer to reduce the strength of the magnetic field and/or increase the speed of the belt 14 after a few months of operation as the size of the metal crystals on the catalyst particles increases. The magnetic field strength can be reduced, for example, by using weaker magnets and/or increasing the thickness of the belt 14.

Finally, it is important to disregard the conventional wisdom as regards metals levels, and adjust the strength of the magnetic field and/or speed of the belt 14 as needed to allow metals content on equilibrium catalyst to increase by at least 25% above the levels previously tolerated in the unit.

For example, in one commercial unit, we were able to increase by roughly 33% the amount of metals that could be tolerated on the catalyst without any adverse effect. The content of nickel plus vanadium in the catalyst was roughly 3000 ppm when magnetic separation was initiated. After about six months of operation, the fluidized catalytic cracking unit could tolerate toughly 4000 ppm nickel plus vanadium without any adverse effect. The magnetized catalyst with 4000 ppm metals behaved like conventional catalyst with 3000 ppm metals in that magnetized catalyst makes less hydrogen and also produces less coke for a given ppm metal as compared to conventional catalyst.

At startup of the magnetic separation, fairly high belt velocities may be used, on the order of 285 rpm, then after one or two months, belt velocities may be decreased to 110 rpm, and eventually increased after a few more months of operation to 250–310 rpm. In many units, iron content and/or nickel and vanadium content varies seasonally with the amount of heavy material fed to the cracking unit. It is beneficial to at least periodically check the feedstock metal content, and adjust operation of the magnetic separation unit accordingly so that a relatively constant amount of material is rejected, say for example, adjusting the speed of belt 14 so that about 20 weight percent of the magnetic catalyst particles is removed as too magnetic. The magnetic separation unit is itself a fairly good indicator of metals level and belt speed can be adjusted as needed to maintain the desired ratio of reject/recycled catalyst.

We do not wish to be bound by our theory of metals deposition; it may be that some utterly different mechanism is responsible for achieving the metals passivation effect.

EXAMPLE

A fluidized catalytic cracking (FCC) unit previously operated without magnetic separation of catalyst was converted to magnetic separation with stacked magnets according to FIGS. 1–4. The belt 14 was 10 mil KEVLAR. The results before and after magnetic separation for a 4-month period of time are presented in the Table.

TABLE

| Description of ECat | Before Magnetic Separation | | After Magnetic Separation | |
|---|---|---|---|---|
| MAT[1] Vol % Conversion | 70.0 | | 70.0 | |
| MAT Yields (Normalized) | vol % | wt % | vol % | wt % |
| Gasoline ($C_5$-221° C.) | 59.41 | 48.91 | 63.31 | 52.26 |
| Gasoline Selectivity | 83.70 | | 90.00 | |
| Total $C_4$'s | 12.83 | 8.43 | 11.3 | 7.42 |
| Isobutane | 6.04 | 3.82 | 5.56 | 3.51 |
| N-Butane | 1.02 | 0.67 | 0.94 | 0.62 |
| Butylene | 5.77 | 3.94 | 4.80 | 3.29 |
| Total $C_3$'s | 7.27 | 4.24 | 6.72 | 3.92 |
| Propane | 1.33 | 0.76 | 1.30 | 0.74 |
| Propylene | 5.94 | 3.48 | 5.42 | 3.18 |
| LCO (221°–232° C.) | 18.46 | 18.51 | 19.03 | 19.2 |
| Heavy Oil (232+ ° C.) | 11.53 | 12.93 | 11.34 | 12.81 |
| Total $C_3$ + Liquid | 109.50 | | 111.70 | |
| Code | | 3.89 | | 2.73 |
| $C_2$ & Lighter | | 1.45 | | 1.43 |
| Hydrogen | | 0.22 | | 0.16 |
| Methane | | 0.39 | | 0.42 |
| Ethane | | 0.35 | | 0.50 |
| Ethylene | | 0.49 | | 0.35 |
| $H_2S$ (+contaminants) | | 1.64 | | 0.23 |
| Total | | 100.00 | | 100.00 |
| Catalyst Metals, ppm | | | | |
| Iron | 7400 | | 7000 | |
| Nickel | 900 | | 1000 | |
| Vanadium | 2100 | | 1700 | |

[1]MAT - Microactivity test per ASTM D-3907-87.

As seen in the Table, operation of the magnetic separation with the stacked magnets results in a higher gasoline selectivity, less coke make and less hydrogen make for the same MAT conversion (ASTM D-3907-87).

Figure 5:
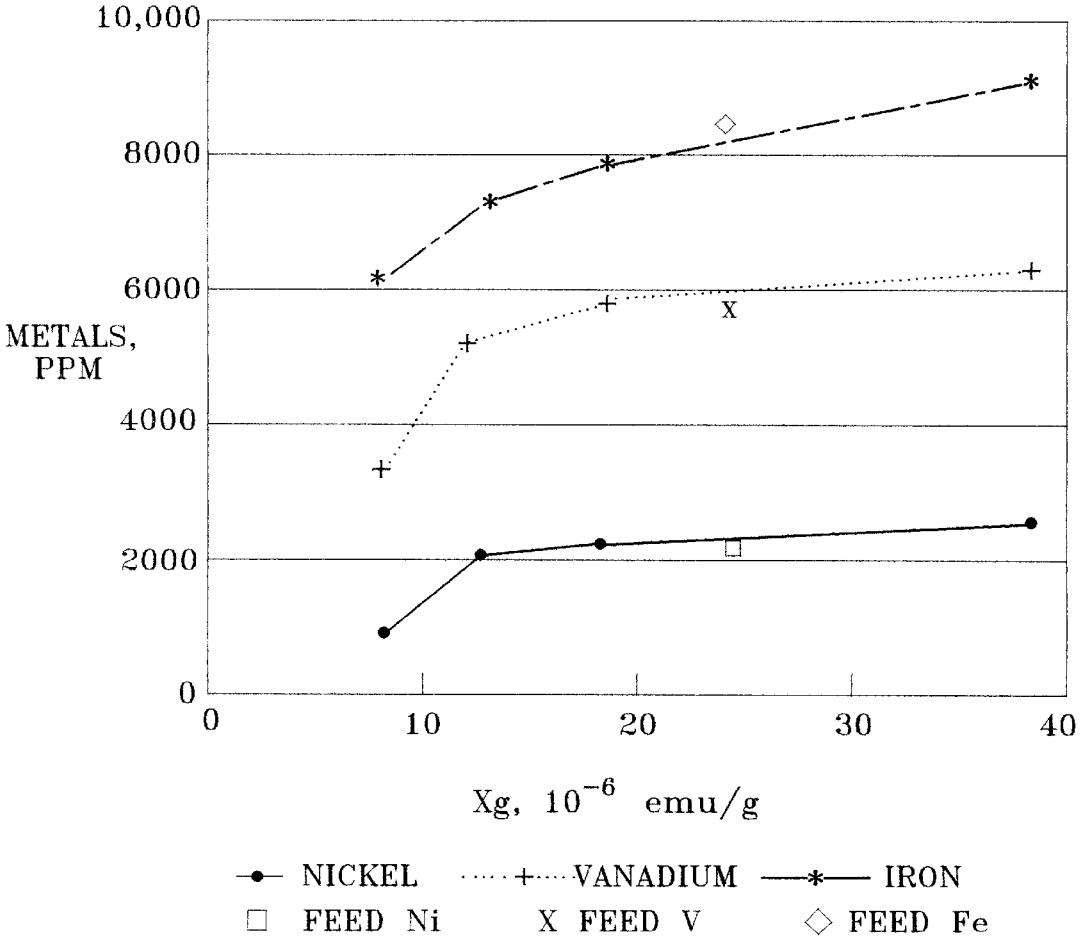
FIG. 5 is a graph showing metals concentration as a function of magnetic susceptability for magnetically separated fractions of aged catalyst and feed metal levels.

FIG. 5 shows changes in magnetic susceptibility before and after magnetic separation with stacked magnets. Consider Ni, which after eight months of magnetic separation showed more than a 20% change in nickel content at the same Xg. This shows an enhanced magnetic effect. This, coupled with the data in the Table show a reduced catalytic effect, both of which effects are consistent with larger nickel crystals.

While there has been illustrated and described particular embodiments of the present invention, it will be appreciated that numerous changes and modifications will occur to those skilled in the art, and it is intended in the appended claims to cover all those changes and modifications which fall within the true spirit and scope of the present invention.

I claim:

1. An apparatus for magnetically separating cracking catalysts comprising:

a flexible continuous woven aromatic polyamide fiber belt movable around first and second rollers at opposite ends thereof for receiving a catalyst stream on an upper surface thereof;

wherein one of the rollers comprises a plurality of stacked radial magnetic discs with like poles facing each other to provide a concentrated magnetic field to influence particles in the catalyst stream having magnetic properties.

2. The apparatus of claim 1 including spacers between adjacent magnetic discs.

3. The apparatus of claim 1 wherein the belt is from 5 to 10 mils thick.

4. The apparatus of claim 1 wherein the first roller is non-magnetic.

5. The apparatus of claim 1 wherein the magnetic discs comprise permanently magnetic rare earth metal.

6. An apparatus for magnetically separating cracking catalysts comprising:

a flexible, continuous 5 to 10 mil thick belt comprising woven aromatic polyamide fiber movable around first and second rollers at opposite ends thereof for receiving a catalyst stream on an upper surface thereof;

wherein one of the rollers is non-magnetic, and the other comprises a plurality of stacked, permanently magnetic rare earth metal discs with like poles facing each other to provide a concentrated magnetic field to influence particles having magnetic properties deposited on the belt from the catalyst stream.

7. The apparatus of claim 6 including spacers disposed between adjacent discs.

8. A method for magnetically separating cracking catalysts comprising:

moving a flexible continuous woven aromatic polyamide fiber belt around first and second rollers at opposite ends thereof wherein one of the rollers comprises a plurality of stacked magnetic discs with like poles facing each other to provide a concentrated magnetic field;

depositing a catalyst stream on an upper surface of the belt;

using the magnetic field to influence particles in the catalyst stream and to separate the stream into at least two fractions comprising a first fraction which has a higher metals content than a second fraction which has a relatively low metals fraction.

9. The method of claim 8 including disposing spacers between adjacent magnetic discs.

10. The method of claim 8 wherein the belt is from 5 to 10 mils thick.

11. The method of claim 8 wherein the first roller is non-magnetic.

12. The method of claim 8 wherein the magnetic discs comprise permanently magnetic rare earth metal.

13. A method for magnetically separating cracking catalysts comprising:

moving a flexible, continuous 5 to 10 mil thick belt comprising woven aromatic polyamide fiber around first and second rollers at opposite ends thereof, wherein one of the rollers is non-magnetic, and the other comprises a plurality of stacked, permanently magnetic rare earth metal discs with like poles facing each other to provide a concentrated magnetic field;

depositing a catalyst stream on an upper surface of the belt;

using the magnetic field to influence particles in the catalyst stream and to separate the stream into at least two fractions comprising a first fraction which has a relatively higher metals content than a second fraction which has a relatively low metals fraction.

14. The method of claim 13 including spacers disposed between adjacent discs.

* * * * *